US006122569A

United States Patent [19]

Ebert et al.

[11] Patent Number: 6,122,569

[45] Date of Patent: Sep. 19, 2000

[54] STORE INTERFACE APPARATUS

[75] Inventors: William J. Ebert, Kirkwood; James V. Leonard, St. Charles; Richard E. Meyer, Florissant, all of Mo.

[73] Assignee: McDonnell Douglas Corporation, St. Louis, Mo.

[21] Appl. No.: 09/191,884

[22] Filed: Nov. 13, 1998

[51] Int. Cl.[7] ..... G06F 7/00

[52] U.S. Cl. ..... 701/3; 701/1; 244/2

[58] Field of Search ..... 701/3, 1; 244/2, 244/3.1; 102/293; 395/821, 840

[56] References Cited

U.S. PATENT DOCUMENTS

| | | | |
|---|---|---|---|
| 4,825,151 | 4/1989 | Aspelin | 324/73 R |
| 5,034,686 | 7/1991 | Aspelin | 324/158 |
| 5,036,465 | 7/1991 | Ackerman et al. | 364/423 |
| 5,036,466 | 7/1991 | Fitzgerald et al. | 364/423 |
| 5,148,734 | 9/1992 | Lilly | 89/1.815 |
| 5,229,538 | 7/1993 | McGlynn et al. | 89/1.56 |
| 5,511,218 | 4/1996 | Castelaz | 395/800 |
| 5,541,839 | 7/1996 | Mitzkus et al. | 244/3.16 |
| 5,548,510 | 8/1996 | Ebert et al. | 364/443 |

*Primary Examiner*—William A. Cuchlinski, Jr.
*Assistant Examiner*—Yonel Beaulieu
*Attorney, Agent, or Firm*—Bryan Cave LLP

[57] ABSTRACT

A store interface for routing different types of store signal formats to multiple wing stations using pre-existing aircraft wing wiring. The store interface provides an interface between an aircraft and an associated store adapted to bidirectionally communicate with the aircraft according to one of a plurality of predetermined store signal formats. The store interface includes a store identifier that determines the type of the associated store, and an interface that bidirectionally communicates between the aircraft and the store, including a first and second communication links that communicate with the store using either a first set of store control signals configured in accordance with a first store signal format or a second set of store control signals configured in accordance with a second store signal format. The store interface also includes a switch that couples one of the communication links to the store in response to the store identifier allowing one of the sets of store control signals to be transmitted between the aircraft and the store.

19 Claims, 5 Drawing Sheets

STORE INTERFACE APPARATUS

FIELD OF THE INVENTION

The present invention relates generally to weapon control systems and, more particularly, to an interface that may be employed to electrically coupled different types of weapons or stores to existing aircraft avionics equipment.

BACKGROUND OF THE INVENTION

Modern military aircraft, such as the F-15E aircraft manufactured by The Boeing Company, the assignee of the present invention, and the P-3, the S-3, and the F-16 aircraft manufactured by the Lockheed Aeronautical Systems Company, are adapted to carry a variety of stores. These stores can include, for example, weapons or missiles, such as the Joint Direct Attach Munition (JDAM), Walleye missile, the Harpoon missile, the Standoff Land Attack Missile (SLAM), the SLAM-ER, and the Maverick missile. The stores can also include communication devices such as a data link pod, which may be used to provide a Radio Frequency (RF) data link between the missile and the host aircraft. For example the data link pod may be associated with a missile to provide an RF/video interface with the crewstation of the aircraft.

The store (either the missile or the data link pod) is generally mounted on the wing of the host aircraft, typically via a disconnectable pylon associated with one of a plurality of wing stations. For example, the P-3 aircraft has six separate wing stations, three located on the port side of the aircraft and three located on the starboard side of the aircraft. Prior to, during and even after deployment of a store, the aircraft and the associated store communicate. For example, signals are bidirectionally transmitted between the aircraft and the store to appropriately configure and launch the store. This prelaunch configuration can include downloading the coordinates of the target and initializing the various sensors of the store. In addition, a store, such as a SLAM missile, can transmit a video image, typically via be monitored, and, in some instances, controlled to provide greater targeting accuracy.

Both the aircraft and the associated store typically communicate and process signals according to a predetermined format. As used herein, format refers not only to the actual configuration of the data structures, but also to the content and order of transmission of the signals, as well as the required electrical connector configuration. The predetermined formats of the aircraft and the store are oftentimes different. In order to ensure proper signal reception by the host aircraft and the associated store, the signals must thus be provided to the aircraft or store in the predetermined format that the aircraft or store is adapted to process.

Additionally, it is not uncommon for different stores to interface with host aircraft in different signal formats. For example, the MK 82 data interface is used to communicate with a host aircraft and certain types of missiles, such as the Harpoon missile, the SLAM missile, and the Harpoon Block II Missile. Another conventional store interface is the Mil-Std-1760A interface, which is used by the SLAM-ER missile, the JDAM missile, and certain types of data link pods, such as the AN/AWW-13 and the DL-2000. The MK 82 and the Mil-Std-1760A interfaces are different, both in the required physical connections and the data structures.

Generally, older aircraft are electrically wired for carriage of certain types of stores requiring certain types of interfaces. By limiting the type of store a particular aircraft may deploy, the aircraft's flexibility is significantly restricted. In order to modify an aircraft to carry a different type of store (e.g., adding the capability of an aircraft to carry a SLAM-ER missile), significant enhancements and modifications must be made to the aircraft. These enhancements and modifications include upgrading the aircraft's various data management and weapon control computers to process data related to the newly-added store, modifying the crewstation to provide the aircrew with the controls and display systems necessary to properly control and launch the newly-added store, and modifying the electrical wiring, cables, and connectors associated with the particular wing station that will accommodate the newly-added store. The modification of the electrical wiring, cables, and connectors associated with a wing station is an expensive and time-consuming task. As such, typically only a subset of the wing stations are so modified to accommodate the newly-added store. After modification, the aircraft is restricted to carrying certain weapons (e.g., MK 82 type weapons) on particular wing stations and other stores (e.g., 1760A type stores) on other wing stations. By limiting the wing stations to carry only one type of store, the flexibility and capability of the aircraft is diminished.

One method and system for deploying several types of stores from a single aircraft is disclosed in Ackramin, Jr. et al. U.S. Pat. No. 5,036,465, Fitzgerald et al. U.S. Pat. No. 5,036,466, and Sianola et al. U.S. Pat. No. 5,129,063, each of which is assigned to Grumman Aerospace Corporation. The systems and methods disclosed in these three patents require modification of the central control processor of the aircraft and the addition of interface electronics.

Commonly assigned U.S. Pat. No. 5,548,510 ("the '510 patent"), the entire disclosure of which is incorporated herein by reference for all purposes, discloses a universal electrical interface between an aircraft and an associated store. The interface of the '510 patent increases the flexibility with which stores can be deployed from an aircraft such that a plurality of types of stores can be launched from a plurality of types of aircraft. In addition, the interface of the '510 patent increases the flexibility with which a store can be deployed from a plurality of types of aircraft without increasing the demand on the aircraft's central control processor, adding additional electronics to the aircraft controls and displays module or modifying the command sequence and associated displays employed by the aircrew to deploy an associated store. Although the '510 patent provides significant improvements to the aircraft's flexibility, the aircraft must generally be modified to provide a means for routing multiple interfaces to multiple wing stations. For example, for a P-3 aircraft, a means of routing both the MK 82 and the Mil-Std-1760 interfaces to multiple pylons via existing MK 82 wing wiring must be added, such that each pylon can interface with (deploy) either a MK 82 type store or a Mil-Std-1760 type store. Both the MK 82 interface and the Mil-Std-1760 interface must share the existing aircraft wing wiring, and sufficient isolation must be provided to prevent interference or overstress to the weapons control system components when both types of stores are in operation. Also, utilization of existing MK 82 aircraft wiring for the Mil-Std-1760 dual redundant multiplex bus and stubs requires impedance matching, isolated bus coupling and switching that is compatible with the arrangement and type of wiring existing in the aircraft and the release status of the store. Preferably, this bus coupling will accommodate single or multiple bus controllers for the data link pods and the weapon stores. Furthermore, protection must be provided to assure that the interface type selected for the wing station conforms to the interface type of the store deployed at the wing station. In addition, some aircraft weapon systems, such as the P-3, allow selection of only one pylon station on each side (port or starboard) of the aircraft at a time. For example, to accommodate the launch of a port side missile when an operating pod is also located on a port side pylon, some provision must be made to provide power to the pod from the starboard side of the aircraft and vice versa; otherwise missile launch would be inhibited until the pod has been shut down. In addition to the data buses, the high bandwith video return signal from the Mil-Std-1760 store interface must be routed through the MK 82 existing aircraft wiring and switched in conjunction with the avionics buses to avoid interference with the MK 82 interface mode of operation.

SUMMARY OF THE INVENTION

An interface apparatus and associated methods having these features and satisfying these needs has now been developed. The preferred apparatus provides an interconnection between the host aircraft and a plurality of different types of stores, each of which is adapted to communicate with the host aircraft according to a different predetermined format. Accordingly, a variety of stores can be deployed from each of the wing stations of an aircraft, without the need for extensive re-wiring of the host aircraft's electrical subsystem.

The preferred interface store apparatus of the present invention provides a means for routing different types of store signal formats (e.g., MK 82 and Mil-Std-1760) to multiple wing stations using the pre-existing aircraft wing wiring in such a way to allow each wing station to interface with each type of store signal format. The interface store apparatus preferably provides an interface between an aircraft and an associated store adapted to bidirectionally communicate with the aircraft according to one of a plurality of predetermined store signal formats and includes store identifier for determining the type of store located on a particular wing station of the host aircraft. The type of store may be one of a plurality of predetermined types of store, each adapted to process signals formatted according to a different one of a plurality of predetermined store signal formats. The interface store apparatus also preferably includes store interface for bidirectionally communicating between the aircraft and the store. The store interface preferably is configured to include a first communication link for communicating with the store using a first set of store control signals configured in accordance with a first store signal format, and a second communication link for communicating with the store using a second set of store control signals configured in accordance with a second store signal format. The preferred store interface further includes a switch for coupling one of the sets of store control signals between the aircraft and the store in response to the store identifier.

In a preferred embodiment of the interface store apparatus, the first communication link comprises a digital data bus having three input signals and one output signal, and the second communication link comprises an avionics bus including primary and reserve data buses for transmitting signals to and from the associated store, and a bus controller for controlling signal transmission on the primary and reserve data buses between the associated store and the aircraft such that the signals are transmitted via the primary bus if the primary bus is available, and are only transmitted via the reserve data bus if the primary bus is unavailable. In this embodiment, the switch preferably couples the digital data bus with the avionics bus if the store identifier determines that the type of associated store is a Mil-Std-1760 type of store.

In another embodiment, the present invention provides a method of applying electrical power and control voltage to a data link pod when a missile is operated on the same side of the aircraft.

In yet another embodiment of the present invention, a method for providing an interface between an aircraft and an associated store is disclosed. This preferred method includes determining the type of the associated store, wherein the type of store is one of a plurality of predetermined types of stores, and wherein each type of store is adapted to process signals formatted according to a different one of the plurality of the predetermined store signal formats, and then communicating either a first set of store control signals configured in accordance with a first store signal format or a second set of store control signals configured in accordance with a second store signal format based on the determination of the type of associated store.

Thus, in accordance with the present invention, each wing station of an aircraft can be electrically interconnected with a plurality of different types of stores, each of which process signals according to a different predetermined format. Accordingly, the aircraft can be deployed with a plurality of different types of stores, which can be carried concurrently on the same aircraft without the need to extensively modify the existing aircraft electrical wiring. Consequently, the number of different types of stores that an aircraft is capable of carrying is increased.

BRIEF DESCRIPTION OF THE DRAWINGS

These and other features, aspects, and advantages of the present invention will become better understood with regard to the following description, appended claims, and accompanying drawings wherein:

These drawings are provided for illustrative purposes only and should not be used to unduly limit the scope of the present invention.

DETAILED DESCRIPTION OF THE INVENTION

Figure 1:
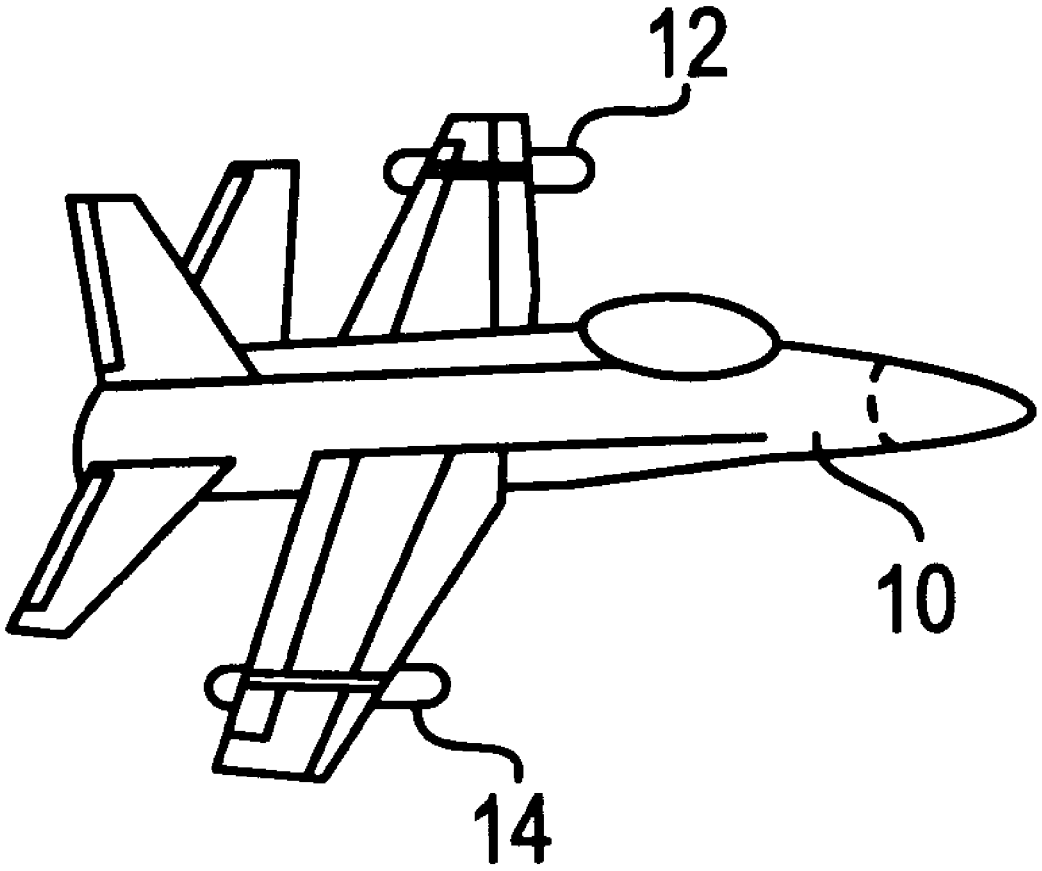
FIG. 1 is a perspective view of an aircraft and associated stores.

FIG. 1 illustrates an aircraft 10 having two types of associated stores, each located on a different wing station of the aircraft 10. The aircraft can be, for example, an F-15E Eagle aircraft manufactured by The Boeing Company, the assignee of the present invention, or a P-3 aircraft manufactured by Lockheed Aeronautical Systems Company. The aircraft 10 can also be, however, any number of other aircraft manufactured by these or other aircraft companies, adapted to communicate with and deploy stores without departing from the spirit and scope of the present invention. A missile 12 represents one type of associated store that may be carried on the aircraft 10. The missile 12 is generally adapted to process signals in accordance with a particular type of store signal format. For example, missile 12 may be a Harpoon missile, manufactured by The Boeing Company, which is adapted to process signals to and from the aircraft 10 in accordance with the signal format known as Harpoon MK 82 Digital Data Bus. Alternatively, missile 12 may be adapted to process signals in accordance with Mil-Std-1760A, which includes a Mil-Std-1553 bus compatibility. Thus, missile 12 may be a Standoff Land Attack Missile—Extended Range (SLAM-ER). In accordance with the present invention, aircraft 12 may carry and deploy a wide variety of missiles, wherein each such missile processes signals and interfaces with the host aircraft 10 according to a different store signal format. Each of the missiles 12 carried on the host aircraft 10 is attached to one of the aircraft's plurality of wing stations.

As also illustrated in FIG. 1, a second type of associated store is a data link pod 14, which provides a radio frequency (RF) command and video interface between a host aircraft 10 and at least some types of associated missiles 12, such as SLAM-ER missiles, preceding and following deployment of the missiles from the aircraft. Exemplary data link pods can include the AN/AWW-13 and DL-2000 guided weapon interfaces developed by the Naval Avionics Center and the industry, or any of a variety of other types of data link pods. The data link pod 14 is also carried on one of the wing stations of the aircraft 10. Using the present invention, the aircraft may be deployed with a variety of store configurations, including a mixture of stores, some of which process signals in accordance with a different format than the others carried on the aircraft 10. In accordance with the present invention, these different types of stores can be loaded onto any one of the wing stations of the aircraft 10 having the present improvement.

Figure 2:
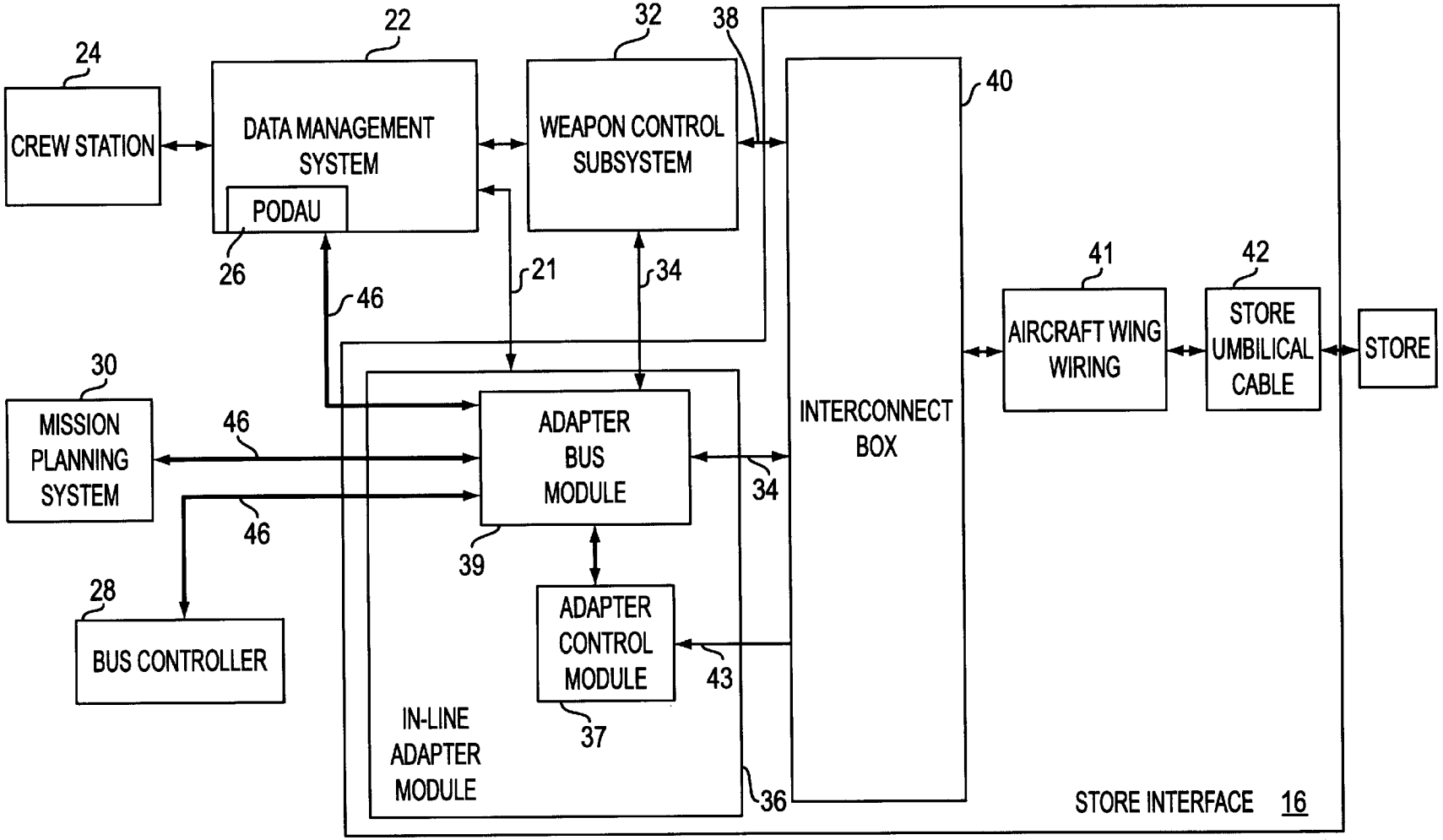
FIG. 2 is a block diagram illustrating one embodiment of the store interface apparatus of the present invention and associated aircraft equipment and store.

As illustrated in FIG. 2, the aircraft includes several conventional pieces of avionics equipment that are used to support and deploy the missiles 12 and data link pods 14. The crewstation 24 generally contains a plurality of controls and displays devices, such as head-down and head-up video displays, a control stick, and a throttle, which are used by the aircrew to fly the aircraft 10 and to interact with, and deploy, the associated stores. The crewstation controls and displays devices communicate with a data management system 22, which controls the overall operation of many of the aircraft subsystems, such as the launch sequence of the weapon store and the command and status messages of the data link pod store. The data management system 22 preferably includes a universal electrical interface 26, known as a Pod Adapter Unit (PodAU), as disclosed in commonly assigned U.S. Pat. No. 5,548,510, which increases the flexibility with which stores can be deployed from aircraft such that a plurality of stores can be launched from a plurality of types of aircraft. The data management system 22 and its universal electrical interface 26 communicate with a number of other avionics equipment via an avionics interface bus 46. Preferably, the avionics interface bus 46 is configured in accordance with Mil-Std-1553, entitled Military Standard Aircraft Internal Time Division Command/Response Multiplex Data Bus (with which its revisions and updates is incorporated by reference herein for all purposes) and includes both a primary and a reserve data bus for transmitting signals between the various pieces of avionics equipment, and a bus controller 28, such as a Mil-Std-1553 bus controller, for controlling signal transmission on the primary and reserve buses. Each of the avionics equipment associated with the avionics bus is considered a bus controller or remote terminal and a single avionics bus configured in accordance with Mil-Std-1553 may support up to 31 separate remote terminals. Preferably, signals are initially attempted to be transmitted via the primary data bus and, if the primary bus is unavailable, the signals are transmitted via the reserve data bus. By providing both the primary and reserve data buses, the reliability of signal transmission between the various pieces of avionics equipment is enhanced. The aircraft 10 may also interface with a mission planning system 30, which communicates with the weapon, thereby loading the weapon with mission parameters prior to the start of the mission, and interfaces with the other aircraft avionics equipment via the avionics interface bus 46. Preferably, the aircraft 10 also includes a weapon control subsystem 32, such as, for example, the Harpoon Aircraft Command and Launch Control Set (HACLCS), used in conjunction with the deployment of Harpoon missiles. The weapon control subsystem 32 directly provides the missile 12 with power, typically three-phase power and 28 V dc power, and a release signal that triggers the deployment of the missile 12. These discrete signals are provided to the missile 12 via the armament control bus 38.

Preferably, the aircraft 10 includes a store interface 16, which is electrically connected to the weapon control subsystem 32 and the data management system 22 and is adapted to bidirectionally communicate with and receive sets of store control signals from the weapon control subsystem 32 and the data management system 22. The in-line adapter module 36 of the store interface 16 preferably includes an adapter bus module 39 and an adapter control module 37. The adapter bus module 39 bidirectionally communicates with the weapon control subsystem 32 via the weapon control interface bus 34, which is configured in accordance with a particular store signal format, such as the MK 82 Digital Data Bus. As is known to those skilled in the art, the MK 82 Digital Data Bus, which is commonly used to communicate with particular missiles, such as the Harpoon missile and the SLAM missile, provides four signals, including three input signals (a clock strobe, a missile data out signal, and a data enable signal), and one output signal (a data in signal). Each of these four signals is coupled into the adapter bus module 39 via the weapon control interface bus 34. The adapter bus module 39 also bidirectionally communicates with the data management system 22 via the avionics interface bus 46. Thus, the adapter bus module 39 is adapted to receive store control signals in accordance with different types of store signal formats, e.g., MK 82 and Mil-Std-1760. Preferably, the adapter bus module 39 mates with the aircraft wing wiring 41 via a conventional interconnect box 40. The interconnect box 40 interconnects the weapon control subsystem 32 and the adapter bus module 39 with aircraft wing wiring 41 located on each of the aircraft wing stations. Preferably, the in-line adapter module 36 mates with existing aircraft wiring (e.g., the weapon control interface bus 34) and, therefore, can be installed as a simple in-line adapter module, so that the existing weapon control interface bus 34, interconnect box 40, and aircraft wing wiring 41 do not require modification. The in-line adapter module 36 is also electrically connected to a store umbilical cable 42 via existing aircraft wing wiring 41, which directly connects to either the missile 12 or the data link pod 14. A preferred implementation of the present invention would incorporate a number of aircraft wing wiring 41 and store umbilical cables 42, equivalent to the number of store stations included on the aircraft. The adapter bus module 39 contains driving relays (not shown) necessary to switch the portion of the weapon control interface bus 34 (extending between the adapter bus module 39 and the interconnect box 40) between either the remaining portion of the weapon control interface bus 34 (extending between the adapter bus module 39 and the weapon control subsystem 32) or the avionics bus 46 (extending between the data management system 22 and the adapter bus module 39, and between the mission planning system 30 and the adapter bus module 39).

When the store umbilical cable 42 is connected to the missile 12, the armament control bus 38 is also electrically coupled to the store umbilical cable 42 via the interconnect box 40 and the aircraft wing wiring 41 to provide power and discretes, such as the release consent signal. As shown in FIG. 2, a preferred configuration would include aircraft wing wiring 41 and a store umbilical cable 42 replicated for each of the wing stations on the aircraft 10. Thus, for a P-3 aircraft having six wing stations, in order to provide flexibility on each wing station, six separate aircraft wing wiring 41 and store umbilical cables 42 would each be electrically coupled to the avionics bus 46 and the weapon control interface bus 34 through the interconnect box 40. A missile 12 or a data link pod 14 loaded onto a particular wing station would then be electrically coupled to a separate store umbilical cable 42 in order to bidirectionally communicate as required with the aircraft 10 and its various avionics equipment including the data management system 22 and weapon control subsystem 32. Thus, the present invention allows existing aircraft to be modified to allow both a MK 82 and a Mil-Std-1760 type of interface to be coupled to multiple wing stations using the existing aircraft wiring in such a way as to allow each wing station to interface to either a MK 82 or a Mil-Std-1760 type of store. The in-line adapter module 36 allows both types of interfaces (MK 82 and Mil-Std-1760) to share the existing aircraft wiring and prevents interference or overstress to the data management system 22 and the weapon control system 32 when both types of stores are operating at the same time (on different wing stations). As discussed below, the particular type of store loaded onto a wing station may require a store-unique store umbilical cable 42 and, therefore, a different store umbilical cable 42 may be required for a Harpoon missile, a SLAM-ER missile, and a data link pod. However, in accordance with the present invention, the in-line adapter module 36 will support a plurality of different stores.

As is known, existing aircraft, such as, for example, a P-3 adapted to deploy the Harpoon missile, have a weapon control subsystem (known as the HACLCS for the Harpoon missile) that is electrically connected to a store umbilical cable via an existing digital data bus (configured as a MK 82 Digital Data Bus). This digital data bus is designed specifically for the Harpoon missile and provides the capability to carry conventional Harpoon signals, such as a clock strobe, a missile data out signal, a data enable signal, and a data in signal, between the weapon control subsystem 32 and the umbilical cable 42. A digital data bus is directly connected from the HACLCS to each of the wing stations adapted to carry the Harpoon missile. As one example of an implementation of the present invention, the in-line adapter cable 36 may be installed as an insert into the digital data bus, without rewiring the entire digital data bus, to enable the in-line adapter module 36 to communicate with the HACLCS. The in-line adapter module 36 may then also be connected the avionics bus 46 to enable it to communicate with the data management system 22 and the mission planning system 30 via a Mil-Std-1553 type interface. Depending on the type of store located on a particular wing station associated with this particular digital data bus, the in-line adapter module 36 may then switch and route the appropriate interface (either the MK 82 Digital Data Bus or Mil-Std-1553 avionics type bus (supporting a Mil-Std-1760 type of store)) to the store umbilical cable 42. Thus, the particular wing station associated with the modified digital data bus is therefore capable of carrying stores adapted to communicate with the aircraft 10 via a Mil-Std-1760 type of interface without having to change aircraft wiring to route the Mil-Std-1553 type avionics bus out to the store umbilical cable 42.

Figure 3:
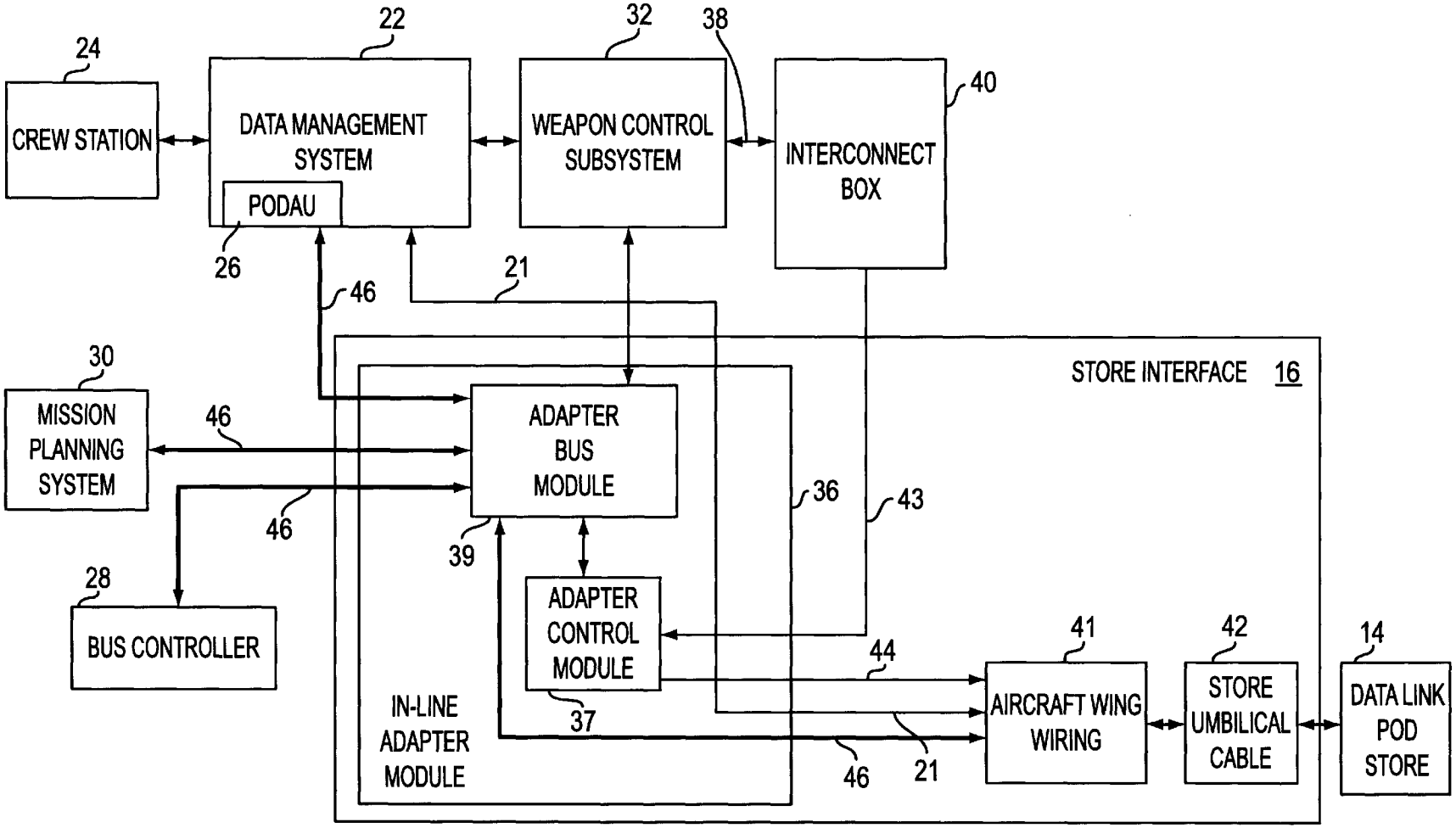
FIG. 3 is a block diagram illustrating another embodiment of the store interface apparatus of the present invention and the associated aircraft equipment and data link pod.

The above-described embodiment may be used to deploy Mil-Std-1760 type missiles and data link pods via the existing weapon control interface bus 34. Another embodiment of the present invention is illustrated in FIG. 3 in which the data link pod 14 is directly coupled to the data management system 22 via the avionics bus 46, and is not coupled via the weapon control interface bus 34. In this embodiment, the data link pod 14 bidirectionally communicates with the data management system 22 through the store umbilical cable 42 and the aircraft wing wiring 41 via the avionics bus 46 without being switched by the in-line adapter module 36 (although the data is coupled through the in-line adapter module 36). In this alternative embodiment, power is supplied to the data link pod store 14 from the adapter control module 37 via the power interface 44. Thus, power originates in the weapon control subsystem 32, is coupled into the interconnect box 40 and is delivered to the control module 37 via the power and control interface 43. Video signals from the data link pod 14 are supplied to the data management system 22 a dedicated video bus 21 extending between the in-line adapter module 36 and the data management system 22.

Figure 4:
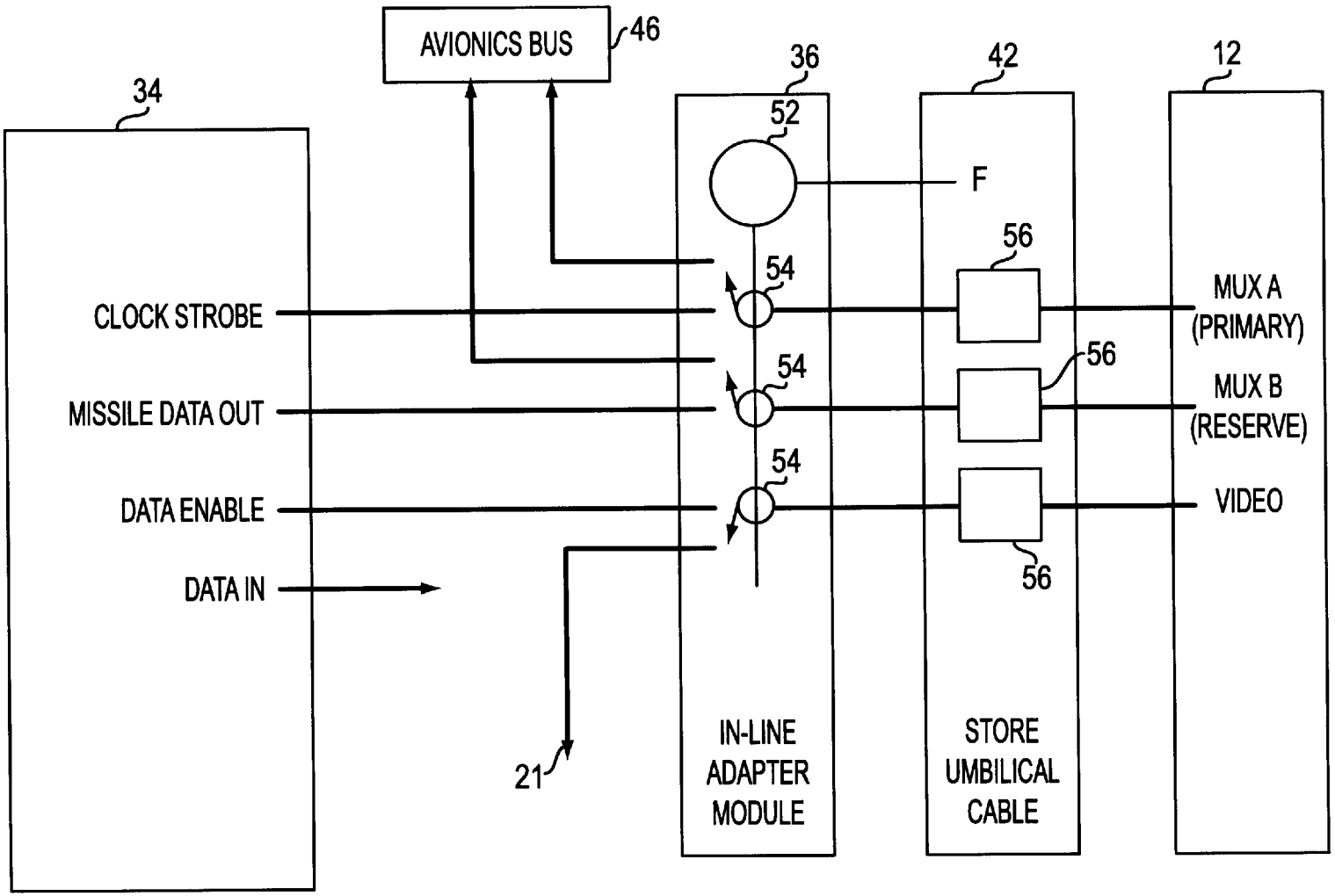
FIG. 4 is partial circuit-level diagram of a preferred store interface apparatus of the present invention, including its electrical connections to associated aircraft equipment and a store.

FIG. 4 illustrates a circuit-level diagram of the preferred store interface 16 coupled to a missile 12. As discussed above, the in-line adapter module 36 is electrically coupled to the weapon control interface bus 34, which provides certain store control signals such as clock strobe, missile data out, data enable, and data in. The in-line adapter module 36 is adapted to selectively electrically couple these store control signals to the missile 12 via the store umbilical cable 42 when the missile is of a type adapted to communicate with the weapon control interface bus 34. For the sake of illustration, the interconnect box 40 and the aircraft wing wiring 41 are not shown on FIG. 4. The in-line adapter module 36 is also electrically connected to the avionics interface bus 46, for receiving store control signals of a second type, such as for stores adapted to process signals in accordance with Mil-Std-1760A. The in-line adapter module 36 selectively couples the signals from either the weapon control interface bus 34 or the avionics interface bus 46 to the store umbilical cable 42 depending on the type of store loaded onto the particular wing station associated with the store umbilical cable 42. For purposes of illustration, FIG. 4 is shown with the in-line adapter module 36 coupled to the store umbilical cable 42 adapted for a store that processes signals in accordance with Mil-Std-1760A. Thus, a store umbilical cable 42 adapted for use in connection with a Mil-Std-1760 type of store would include necessary bus isolation couplers 56 as is standard in conventional Mil-Std-1553 avionics multiplex bus systems.

The in-line adapter module 36 preferably includes a switch for coupling one of the received sets of store control signals to the store, for example, a relay switch 52, which controls a series of switches 54 that allow the in-line adapter module 36 to switch between coupling the signals from the weapon control interface bus 34 or the avionics interface bus 46 to the store umbilical cable 42. Although FIG. 4 shows a simple relay switch 52, any other type of device that performs the function of switching may also be used. As shown in FIG. 4, the relay switch 52 switches one output signal from the in-line adapter module 36 between the clock strobe signal of the weapon control interface bus 34 and Mux A of the avionics interface bus 46, and switches another output signal from the in-line adapter module 36 between the missile data out signal of the weapon control interface bus 34 and Mux B of the avionics interface bus 46. Thus, the switch 52 couples a portion of the digital data bus to the avionics bus. As those skilled in the art will appreciate, other configurations may be implemented without departing from the spirit and scope of the present invention. For example, the in-line adapter module 36 may switch between Mux A of the avionics interface bus 46 and the data enable signal of the weapon control interface bus 34. Additionally, the in-line adapter module 36 switches the Mil-Std-1760 video output (coupled, for example, to the data enable line) from the missile 12 to the dedicated video bus 21. Although not shown, it will be appreciated that when a conventional store adapted to communicate with the weapon control interface bus 34 (such as a MK 82 type of weapon), the in-line adapter module 36 switches to allow the four convention signals (clock strobe, missile data out, data enable, and data in) to the appropriate terminals of the store umbilical cable adapted for use in connection with this particular type of store. As can be appreciated, the in-line adapter module 36 associated with a particular wing station isolates the weapon control subsystem 32 from the missile 12 when a Mil-Std-1760 type of store is detected on that particular wing station. Additionally, the switches 54 of the in-line adapter module 36 associated with a particular wing station isolate the avionics bus 46 and the data management system 22 from that wing station when a MK 82 type of store is loaded onto the particular wing station.

Figure 5:
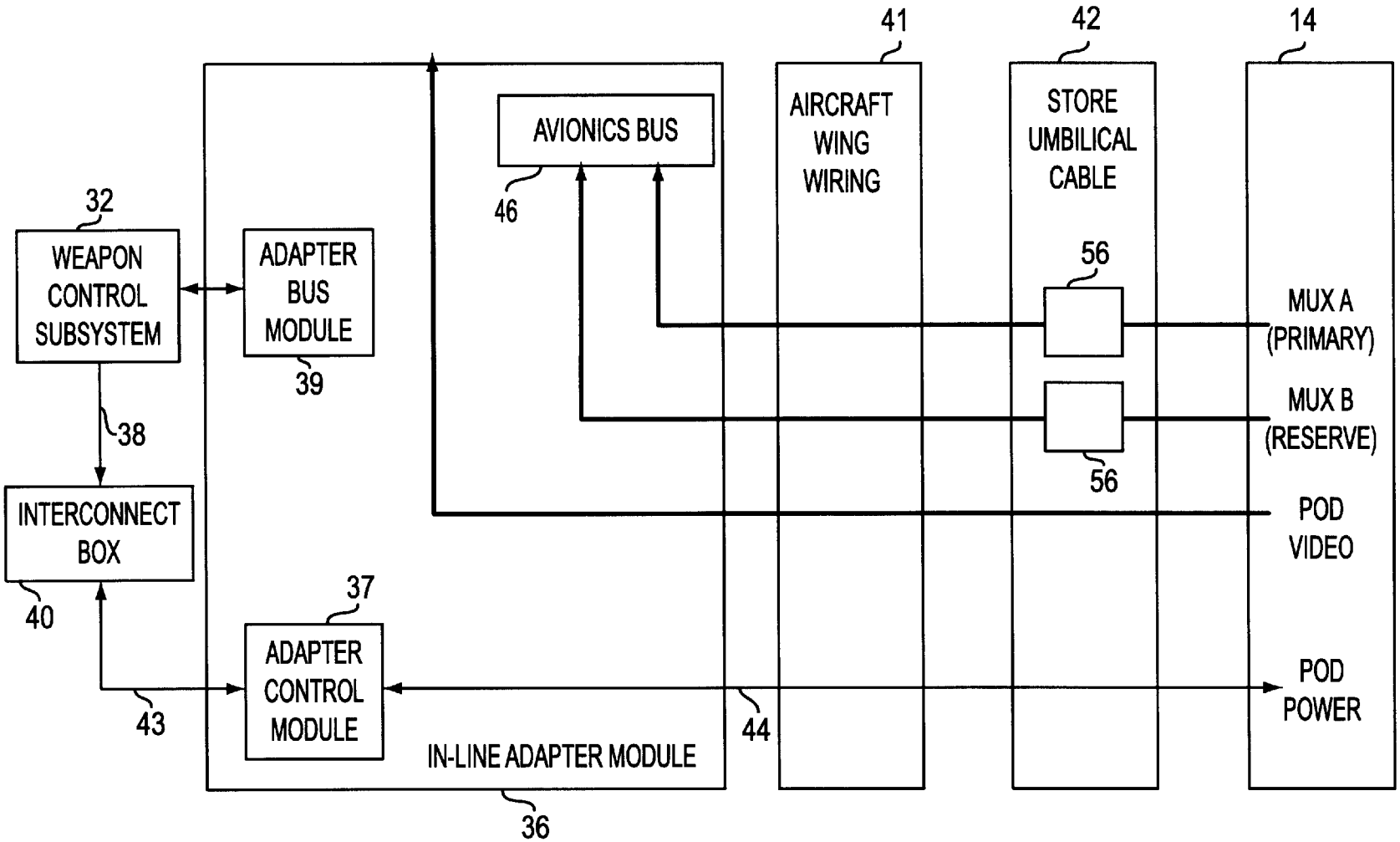
FIG. 5 is another partial circuit-level diagram of another preferred store interface apparatus of the present invention, including its electrical connections to associated aircraft equipment and a data link pod.

Preferably, when a data link pod 14 is attached to a particular wing station, as shown in FIG. 5, the in-line adapter 36 electrically couples the primary and reserve data buses of the avionics bus 46 to the appropriate inputs on the store umbilical cable 42 (that is adapted for use in connection with the data link pod 14). Thus, the primary bus of the avionics bus 46 is coupled to the primary bus of the data link pod 14, the reserve bus of the avionics bus 46 is coupled to the reserve bus of the data link pod 14, and the dedicated video bus 21 is coupled to the video outputs of the data link pod 14. In this embodiment, the in-line adapter module 36 is connected to the aircraft wing wiring 41 of the aircraft store station bearing the data link pod 14.

Preferably, the control module 37 is also responsible for controlling the power used to operate the data link pod 14. Power for the data link pod 14 is supplied as a port or starboard source from within the weapon control subsystem 32 to the control module 37 within the in-line adapter module 36. The control module 37 determines the active source of power from the weapon control subsystem 32 and switches it through the output of the in-line adapter module 36 to the data link pod 14 via the aircraft wing wiring 41 and the store umbilical cable 42. The control module 37 receives multiple power circuits from the weapon control subsystem 32 and connects only the active power circuit to the data link pod 14 via the power interface 44. This provides a method of selecting either a port or a starboard store station for a source of power for the data link pod 14, independent of the location of the pod 14 on the aircraft 10, thereby allowing the use of any weapon store station on the aircraft while at the same time supplying the power to the data link pod 14. This embodiment accommodates the data link pod 14, which does not require the control signals from the weapon control subsystem 32, by redirecting the aircraft wing wiring 41 to the in-line adapter module 36 without the need to switch the avionics data bus 46 or the Mk 82 digital data bus 34. Preferably, in this embodiment, the video output and the recorder audio input for the data link pod 14 are not switched by the in-line adapter module 36, but, rather bypass the Mk 82 bus wiring located within the interconnect box 40 and are directed to the data management system 22 via the in-line adapter module 36 on the dedicated video bus 21.

The store interface 16 preferably includes store identifier for determining the type of store associated with the particular wing station. The type of store is preferably one of the plurality of predetermined types of stores, each of which is adapted to process signals formatted according to a different predetermined format. For example, the associated stores can include stores that process signals in accordance with either MK 82 (e.g., a Harpoon missile or SLAM) or Mil-Std-1760A (e.g., a SLAM-ER missile or an AN/AWW-13 data link pod, or any other similar type of store). Thus, as shown in FIG. 4, the relay switch 52 is directly electrically connected to one pin of the store umbilical cable 42, which receives an electrical signal when the store umbilical cable 42 is connected to a Mil-Std-1760A type of store. For example, the relay switch 52 may be connected via pin F on a conventional SLAM-ER umbilical cable to the ground for the missile present signal of the SLAM-ER missile. Thus, when a Mil-Std-1760A type of missile is connected to the store umbilical cable 42, the relay switch 52 is triggered and switches the switches 54 of the in-line adapter module 36 so that primary and reserve data buses of the avionics are electrically coupled to the primary and reserve data buses of the missile 12 via the store umbilical cable 42. Alternatively, when a conventional type of store is connected to the store umbilical cable 42, wherein the store will not send a signal on the missile present signal, the relay switch 52 will not activate the switches 54 of the in-line adapter module 36 and the in-line adapter module 36 will electrically couple the standard MK 82 store control signals to the appropriate pins of the missile 12 via the store umbilical cable 42.

Preferably, when the store umbilical cable 42 is of a type adapted for use with a Mil-Std-1760A type of interface is used, the cable 42 includes data bus isolation couplers 56, which provide the electrical direct current isolation, signal magnitude transformation, and impedance matching needed to match the existing aircraft wiring to the impedance levels of the Mil-Std-1553 bus and stubs, and to match the signal voltage level for, and provide isolation needed by, the bus controller and remote terminals. The sizing of the coupler transformation ratio and the sizing of the resistive impedances included within the isolation couplers 56 are selected to allow the use of the existing aircraft wiring and to provide the short circuit protection needed in the Mil-Std-1760 interface.

The present invention also preferably provides a method of applying electrical power and control voltage to the data link pod 14 from either the port or starboard aircraft power source. As is known, many conventional aircraft, such as the P-3, are only capable of powering only one store (either a missile or a data link pod) on each side of the aircraft (either port or starboard). The present invention allows the use of both a missile store and a data link pod on pylons located on the same side of the aircraft by switching power from the unused side to supply electrical power and control voltage to the data link pod. Upon detecting a missile 12 on one side of the aircraft 10, the in-line adapter module 36 couples power from the other side of the aircraft 10 to the data link pod 14. This is preferably accomplished by the aircrew by selecting the port or starboard power as the source for the pod at the crew station 24, which energizes the corresponding port or starboard power within the weapon control subsystem 32. The weapon control subsystem 32 directs all power circuits through the armament control bus 38 to the interconnect box 40. The control module 37 within the in-line adapter module receives both port and starboard power circuits from the interconnect box 40 through the power and control interface 43 and switches the power circuit (port or starboard) that is energized to the data link pod 14 via the aircraft wing wiring 41.

Although the present invention has been described in considerable detail with reference to certain presently preferred embodiments thereof, other embodiments are possible without departing from the spirit and scope of the present invention. Therefore the appended claims should not be limited to the description of the preferred versions contained herein.

What is claimed is:

1. An apparatus providing an interface between an aircraft and an associated store, wherein the associated store is one of a plurality of predetermined types of stores, and wherein each type of store is adapted to process signals and communicate with the aircraft according to one of a plurality of predetermined store signal formats, comprising:

a store interface that bidirectionally communicates between the aircraft and the store, the store interface comprising:

a first communication link comprising a digital data bus comprising three input signals and one output signal, the three input signals comprising a clock strobe signal, a data out signal, and a data enable signal, wherein the first communication link bidirectionally communicates with the store using a first set of store control signals configured in accordance with a first store signal format;

a second communication link comprising an avionics bus comprising:

primary and reserve data buses for transmitting signals to and from the associated store; and a bus controller for controlling signal transmission on the primary and reserve data buses between the associated store and the aircraft such that the signals are transmitted via the primary bus if the primary bus is available, and are only transmitted via the reserve data bus if the primary bus is unavailable, wherein the second communication link bidirectionally communicates with the store using a second set of store control signals configured in accordance with a second store signal format; and a switch that couples one of the communications links to the store allowing one of the sets of store control signals to be transmitted between the aircraft and the store, and that couples a portion of the digital data bus to the avionics bus if the type of associated store is a Mil-Std-1760 type of store.

2. The apparatus of claim 1 wherein the primary data bus is switched to one of the three input signals and the reserve data bus is switched to a different one of the three input signals if the type of associated store is a Mil-Std-1760 type of store.

3. The apparatus of claim 1 further comprising a store umbilical cable that electrically couples the store interface to the store, wherein both the store interface and the store umbilical cable include impedance matching and isolation coupling elements that substantially match the impedance of the communication links and the store.

4. The apparatus of claim 1 wherein the first type of store signal format is Harpoon Mk 82 Digital Data Bus format and the second type of store signal format is Mil-Std-1760 format.

5. The apparatus of claim 1 wherein the aircraft comprises a data management system that provides the first set of store control signals configured in accordance with the first type of store control signal format and a weapon controller that provides the second set of store control signals configured in accordance with the second type of store signal format, wherein the store interface receives the first set of store control signals from the data management system and receives the second set of store control signals from the weapon controller.

6. The apparatus of claim 5 wherein the weapon controller further provides discrete store control signals to the store.

7. The apparatus of claim 1 wherein the associated store is either a missile or a data link pod.

8. The apparatus of claim 5 wherein the aircraft has a missile loaded onto one side of the aircraft and a data link pod loaded on another side of the aircraft, and wherein the store interface receives multiple power circuits from the weapon controller and couples a different one of the power circuits to both the missile and the data link pod.

9. The apparatus of claim 7 wherein the missile and the data link pod are located on the same side of the aircraft.

10. An apparatus providing an interface between an aircraft and an associated store, wherein the aircraft has aircraft wing wiring adapted for transmitting signals according to a first store signal format and wherein the associated store is one of a plurality of predetermined types of stores, and wherein each type of store is adapted to process signals form and bidirectionally communicate with the aircraft according to either the first or a second store signal format, comprising:

a store interface that bidirectionally communicates between the aircraft and the store, the store interface comprising:

a first communication link comprising a digital data bus comprising three input signals and one output signal, the three input signals comprising a clock strobe signal, a data out signal, and a data enable signal, wherein the first communication link bidirectionally communicates with the store using a first set of store control signals configured in accordance with a first store signal format;

a second communication link comprising an avionics bus comprising:

primary and reserve data buses for transmitting signals to and from the associated store; and a bus controller for controlling signal transmission on the primary and reserve data buses between the associated store and the aircraft such that the signals are transmitted via the primary bus if the primary bus is available, and are only transmitted via the reserve data bus if the primary bus is unavailable, wherein the second communication link bidirectionally communicates with the store using a second set of store control signals configured in accordance with a second store signal format; and a switch that couples one of the communications links to the store allowing one of the sets of store control signals to be transmitted between the aircraft and the store, and that couples a portion of the digital data bus to the avionics bus if the type of associated store is a Mil-Std-1760 type of store, wherein both the first and second communication links use the aircraft wing wiring to communicate with the store.

11. The apparatus of claim 10 wherein the primary data bus is switched to one of the three input signals and the reserve data bus is switched to a different one of the three input signals if the store identifier determines that the type of associated store is a Mil-Std-1760 type of store.

12. The apparatus of claim 10 further comprising a store umbilical cable that electrically couples the store interface to the store, wherein both the store interface and the store umbilical cable include impedance matching and isolation coupling elements that substantially match the impedance of the communication links and the store.

13. An apparatus providing an interface between an aircraft and an associated store, wherein the associated store is adapted to communicate with the aircraft according to either the first or a second store signal format, the apparatus comprising:

a. a store identifier that determines the type of the associated store, wherein the type of store is one of two predetermined types of stores, and wherein each type of store is adapted to process signals formatted according to one of either the first store signal format or the second store signal format; and b. a store interface that bidirectionally communicates between the aircraft and the store, the store interface comprising:

a first communication link comprising a digital data bus comprising three input signals and one output signal, the three input signals comprising a clock strobe signal, a data out signal, and a data enable signal, wherein the first communication link bidirectionally communicates with the store using a first set of store control signals from the aircraft, the first set of control signals configured in accordance with a first store signal format;

a second communication link comprising an avionics bus comprising:

primary and reserve data buses for transmitting signals to and from the associated store; and a bus controller for controlling signal transmission on the primary and reserve data buses between the associated store and the aircraft such that the signals are transmitted via the primary bus if the primary bus is available, and are only transmitted via the reserve data bus if the primary bus is unavailable, wherein the second communication link bidirectionally communicates with the store using a second set of store control signals from the aircraft, the second set of control signals configured in accordance with a second store signal format; and a switch that couples one of the communications links to the store allowing one of the sets of store control signals to be transmitted between the aircraft and the store, and that couples a portion of the digital data bus to the avionics bus if the type of associated store is a Mil-Std-1760 type of store.

14. The apparatus of claim 13 wherein the primary data bus is switched to one of the three input signals and the reserve data bus is switched to a different one of the three input signals if the store identifier determines that the type of associated store is a Mil-Std-1760 type of store.

15. The apparatus of claim 13 further comprising a store umbilical cable that electrically couples the store interface to the store, wherein both the store interface and the store umbilical cable include impedance matching and isolation coupling elements that substantially match the impedance of the communication links and the store.

16. An apparatus providing an interface between an aircraft and an associated store, wherein the associated store is adapted to bidirectionally communicate with the aircraft according to one of a plurality of predetermined store signal formats, comprising:

a. a data management system that provides a set of store control signals configured in accordance with a first type of store control signal format;

b. a weapon controller that provides a set of store control signals configured in accordance with a second type of store signal format and for providing discrete store control signals to the store;

c. a store identifier that determines the type of the associated store based on an electrical signal generated by the presence of the associated store, wherein the type of store is one of a plurality of predetermined types of stores, and wherein each type of store is adapted to process signals formatted according to a different one of the plurality of the predetermined store signal formats; and d. a store interface that bidirectionally communicates between the aircraft and the store, the store interface comprising:

a first communication link that transmits a first set of store control signals configured in accordance with a first store signal format from the data management system, the first communicating means comprising primary and reserve data buses for transmitting signals to and from the associated store, and a bus controller for controlling signal transmission on the primary and reserve data buses between the associated store and the aircraft such that the signals are transmitted via the primary bus if the primary bus is available, and are only transmitted via the reserve data bus if the primary bus is unavailable;

a second communication link that transmits a second set of store control signals configured in accordance with a second store signal format from the weapon controller;

a switch that couples one of the communication links to the store in response to the store identifier allowing one of the sets of store control signals to be transmitted between the aircraft and the store; and e. a store umbilical cable that electrically couples the store interface to the store, wherein both the store interface and the store umbilical cable include impedance matching and isolation coupling elements that substantially match the impedance of the communication links and the store.

17. A method for providing an interface between an aircraft and an associated store, wherein the associated store is adapted to communicate with the aircraft according to one of a plurality of predetermined store signal formats, the method comprising the steps of:

a. determining the type of the associated store based on an electrical signal generated by the presence of the associated store, wherein the type of store is one of a plurality of predetermined types of stores, and wherein each type of store is adapted to process signals formatted according to a different one of the plurality of the predetermined store signal formats; and b. communicating either a first set of store control signals configured in accordance with a first store signal format or a second set of store control signals configured in accordance with a second store signal format based on the determination of the type of associated store.

18. A method for providing an interface between an aircraft and an associated store, wherein the aircraft has a first store interface that bidirectionally communicates a first set of store control signals between the aircraft and the store in accordance with a first store signal format, the method comprising the steps of:

a. coupling a second store interface to the first store interface that bidirectionally communicates a second set of store control signals between the aircraft and the store in accordance with the second store signal format;

b. determining the type of the associated store based on an electrical signal generated by the presence of the associated store, wherein the type of store is one of a plurality of predetermined types of stores, and wherein each type of store is adapted to process signals formatted according to a either the first or a second store signal format;

and either:

c. communicating the first set of store control signals configured in accordance with the first store signal format; or d. communicating the second set of store control signals configured in accordance with the second store signal format.

19. A method of modifying an aircraft to provide an interface between the aircraft and an associated store, wherein the aircraft has aircraft wing wiring adapted for transmitting signals according to a first store signal format and wherein the associated store is adapted to bidirectionally communicate with the aircraft according to either the first or a second store signal format, the method comprising the steps of:

a. determining the type of the associated store based on an electrical signal generated by the presence of the associated store, wherein the type of store is one of a plurality of predetermined types of stores, and wherein each type of store is adapted to process signals formatted according to either the first or the second store signal format; and b. communicating either a first set of store control signals configured in accordance with a first store signal format or a second set of store control signals configured in accordance with a second store signal format based on the determination of the type of associated store.

* * * * *